United States Patent [19]

Chu et al.

[11] Patent Number: 4,800,838

[45] Date of Patent: Jan. 31, 1989

[54] FRAME FIXTURE FOR CAMOUFLAGE PAINTING

[75] Inventors: Yen C. Chu, Cupertino; Edward N. Berticevich; Max J. Soldenwagner, both of San Jose, all of Calif.

[73] Assignee: FMC Corporation, Chicago, Ill.

[21] Appl. No.: 101,702

[22] Filed: Sep. 28, 1987

[51] Int. Cl.[4] ..... B05C 21/00

[52] U.S. Cl. ..... 118/505; 118/301

[58] Field of Search ..... 118/301, 504, 505

[56] References Cited

U.S. PATENT DOCUMENTS 3,688,740 9/1972 Gesche ..... 118/504

*Primary Examiner*—John McIntosh

*Attorney, Agent, or Firm*—L. B. Guernsy; R. B. Megley; H. M. Stanley

[57] ABSTRACT

A frame fixture for use with a source of spray paint for camouflage painting of vehicles. A frame is formed in a shape corresponding generally to the shape of a portion of a vehicle to be painted. A plurality of strips connected to the frame divides an area inside the frame into a plurality of areas corresponding to areas to be painted on the vehicle. The strips can be mounted a predetermined distance from the vehicle to allow paint to spray into an area between the strips and the vehicle.

6 Claims, 2 Drawing Sheets

FRAME FIXTURE FOR CAMOUFLAGE PAINTING

BACKGROUND OF THE INVENTION

The present invention relates to camouflage patterns for military vehicles, and more particularly, to a tool for reducing the time required for applying a camouflage pattern to a military vehicle.

Military vehicles are commonly painted with a variety of paints in a camouflage pattern to reduce the risk of detection and to make the vehicles more difficult targets to hit. A method used in painting the vehicles is to outline the camouflage pattern on the vehicles using free hand drawing or use a slide projector to project a pattern on the vehicle in a dark room and trace the projected outlines. Paint is then applied using the outlines on the vehicle as guides. This requires two steps of operation along with some training and skill in order to obtain a good pattern. The resulting painted patterns are not consistent from one vehicle to another.

SUMMARY OF THE INVENTION

The present invention discloses a frame fixture having a plurality of strips mounted to form the camouflage pattern. The fixture is temporarily mounted on the vehicle and paint sprayed on the surface areas of the vehicle which are defined by the strips of the fixture. The fixture is mounted with the strips a short distance from the vehicle so the paint from one area of the fixture blends into the paint in an adjacent area. This blending prevents the formation of sharply defined outlines of the various areas and makes the camouflage pattern more effective. When the strips are formed from flat ribbons of material mounted edgewise to the vehicle, the strips provide masking of areas adjacent to the area being painted.

DESCRIPTION OF THE PREFERRED EMBODIMENT

Figure 1:
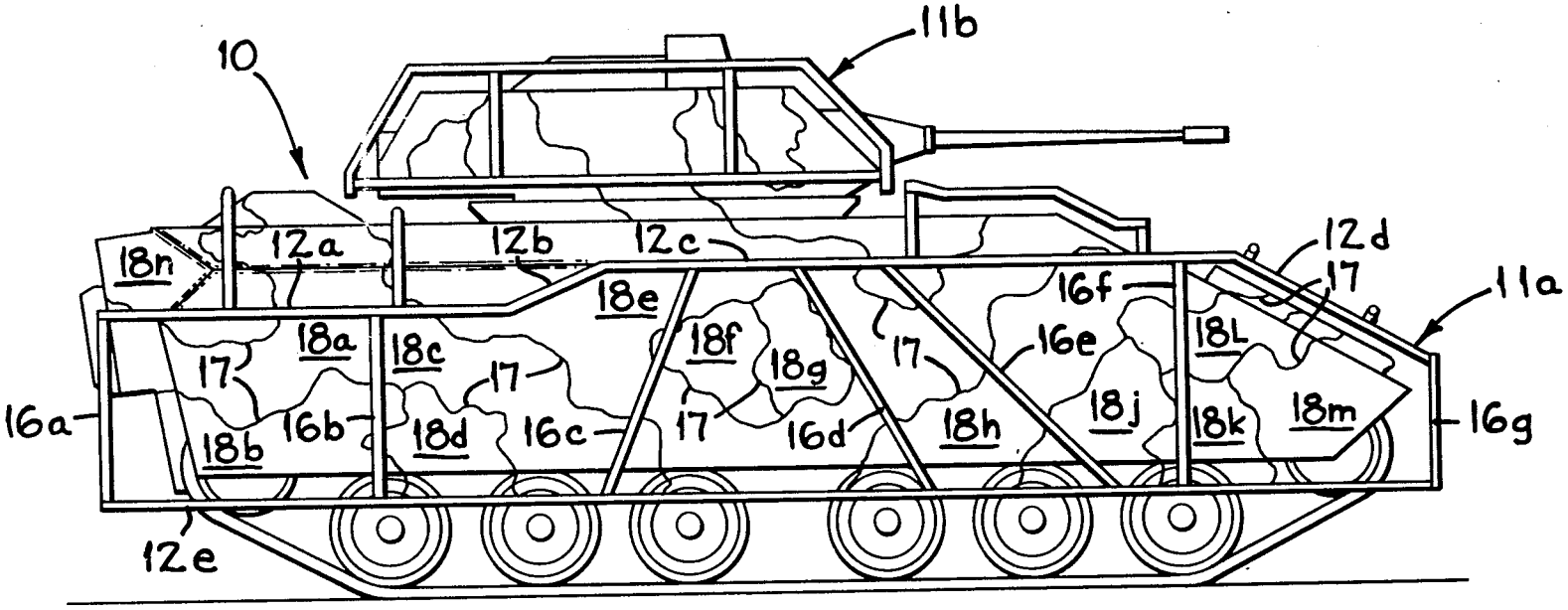
FIG. 1 is a side elevation of a military vehicle with frame fixtures of the present invention mounted adjacent to the vehicle in position for spraying paint on the vehicle surface.

A military vehicle 10 having a plurality of frame fixtures 11a, 11b of the present invention for use in camouflage painting is shown in FIG. 1. Several other frame fixtures, some with straight frame members and other fixtures with curved frame members can be used as guides for painting various portions of the vehicle. Frame fixture 11a includes a plurality of generally horizontal frame members **12*a*–12*e* connected to a plurality of generally vertical frame members 16*a*–16*g* to provide strength and stability to the frame fixture. A plurality of strips 17 are interconnected to each other and to frame members 12*a*–12*e*, 16*a*–16*g*. The strips 17 outline a plurality of surface areas 18*a*–18*n*** for painting in a predetermined color pattern and each area can be spray painted using the strips as guides.

Figure 2:
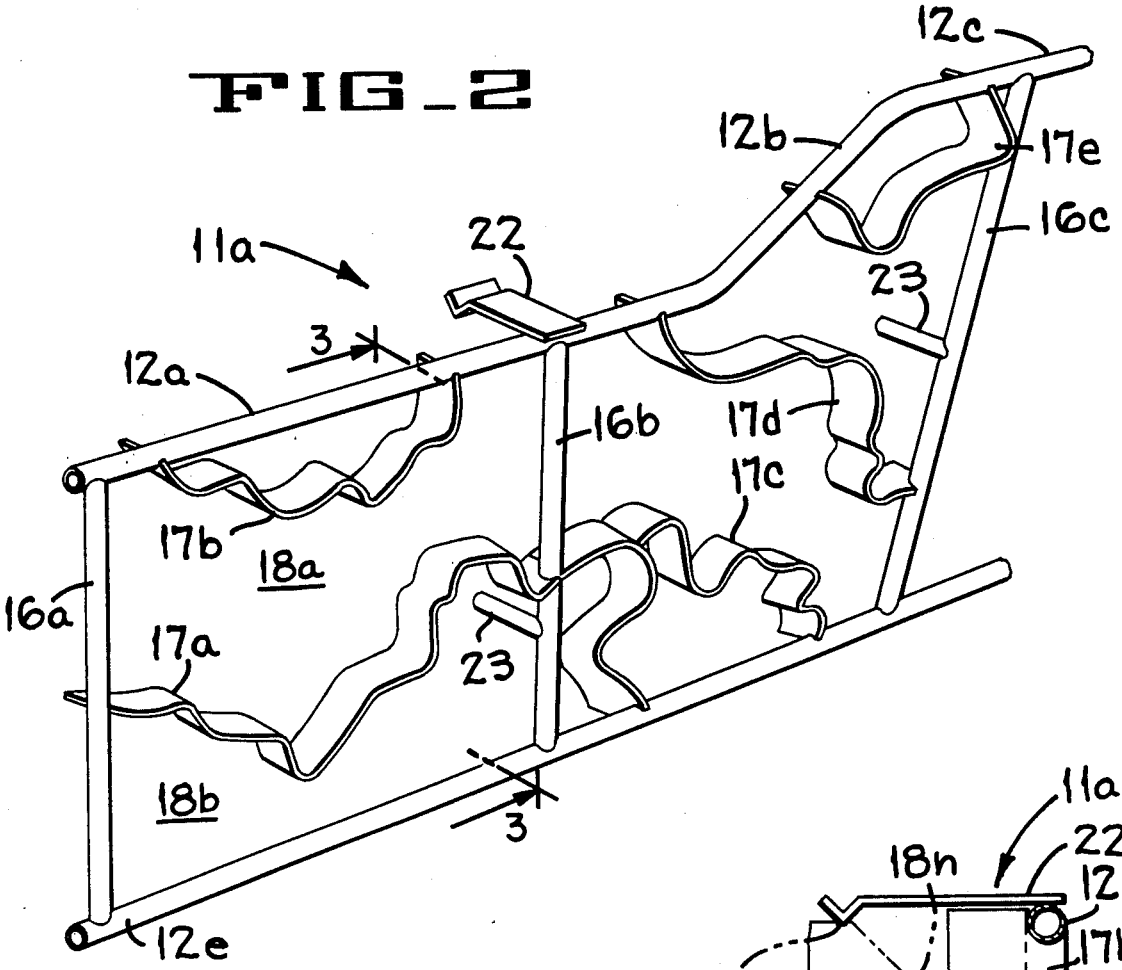
FIG. 2 is a perspective view of a portion of the frame fixture showing details of the fixture.
Figure 3:
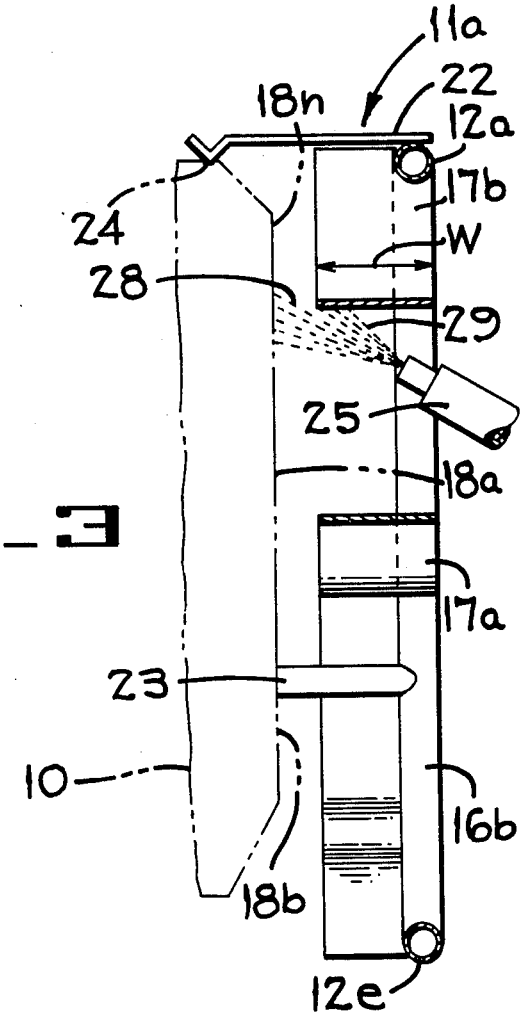
FIG. 3 is an end view of the fixture taken along line 3—3 of FIG. 2.

The strips **17*a*–17*e* (FIG. 2) are used to outline surface areas and to provide a degree of masking of one area from another area. The frame fixture 11*a* (FIGS. 2, 3) is supported on vehicle 10 by a plurality of support members 22 (only one being shown) and spaced from the surfaces 18*a*–18*n* by a plurality of spacers 23 connected to vertical members 16*b*, 16*c*. Support members 22 are each positioned on a position mark 24 (FIG. 3) on the vehicle 10 to ensure proper positioning of frame fixture 11*a* relative to vehicle 10. Other spacers (not shown) may be connected to vertical and horizontal frame members 16*a*–16*g*, 12*a*–12*e* as needed to obtain optimum spacing between the vehicle 10 and strips 17*a*–17*e*. The strips 17*a*–17d (FIG. 2) are approximately three inches across (dimension w, FIG. 3) and are mounted edgewise to the vehicle 10 to provide a controlled masking of areas adjacent to the area being sprayed. For example, when area 18*a* is being sprayed a spray nozzle 25 (FIG. 3) can be moved to a position between strips 17*a*, 17*b* adjacent to area 18*a*. As the spray nozzle 25 approaches strip 17*b* a small amount of paint 28 moves between strip 17*b* and vehicle 10 into area 18*n* to provide a gradual blending of the color of area 18*a* into the color of area 18*n*. Strip 17*b* provides masking of other portions of area 18*n* by intercepting a portion of paint 29 when the spray nozzle is close to area 18*a*. The other strips 17*a*–17*e*** provide similar masking and blending of paints of adjacent areas.

In addition to providing a masking pattern for spraying of paints, the present invention can also be used as a template to check the accuracy of camouflage patterns which may be painted on vehicles by automated spraying systems. The frame fixture **11*a* can be placed adjacent to vehicle 10 (FIG. 1) and the painted areas on the vehicle compared to the locations of strips 17*a*–17*e*. Frame fixture 11*a*** provides a predetermined standardized camouflage pattern for teaching/programming an automated spraying system, such as a robot. The strips can serve as guides for an operator to teach or program a robot.

The frame fixture of the present invention provides a predetermined standardized camouflage pattern for vehicles and provides for gradual blending of a color in one surface area with colors of surfaces in adjacent areas. The frame fixture also provides a means for rapidly checking accuracy of a camouflage paint design against a standard design.

Although the best mode contemplated for carrying out the present invention has been herein shown and described, it will be apparent that modification and variation may be made without departing from what is regarded to be the subject matter of the invention.

What is claimed is:

1. A frame fixture for camouflage painting of vehicles, said fixture comprising:

a frame formed in a shape corresponding generally to the shape of a portion of a vehicle to be painted;

support means for mounting said frame in a predetermined position adjacent to said vehicle;

a plurality of strips, each of said strips being connected to said frame to divide an area of said frame into a plurality of smaller areas, said smaller areas corresponding to a plurality of areas to be painted on said vehicle; and a plurality of spacers, said spacers being connected to said frame to position said strips a predetermined distance from said vehicle when said frame is mounted adjacent to said vehicle to allow paint to move between said strips and said vehicle to cause a blending of paint into areas adjacent to an area being sprayed with paint.

2. A frame fixture as defined in claim 1 wherein:

said strips are formed from flat ribbons of material mounted edgewise to said vehicle to provide masking of areas adjacent to an area being sprayed with paint.

3. A frame fixture as defined in claim 1 wherein said support means includes a plurality of support members, each of said support members being connected to said frame, each of said support members extending outward from said frame to contact a portion of said vehicle and support said frame.

4. A frame fixture for camouflage painting of vehicles for use with a source of spray paint, said fixture comprising:

a plurality of generally horizontal frame members;

a plurality of generally vertical frame members, each of said vertical frame members being connected between selected pairs of said horizontal frame members to form a rigid frame said frame corresponding generally to the shape of a portion of a vehicle to be painted;

support means connected to said rigid frame for mounting said rigid frame in a predetermined position adjacent to said vehicle;

a plurality of strips, each of said strips being connected to said rigid frame to divide an area inside said rigid frame into a plurality of irregularly shaped smaller areas, said smaller areas corresponding to a plurality of areas to be painted on said vehicles; and a plurality of spacers, said spacers being connected to said rigid frame to position said strips a predetermined distance from said vehicles when said rigid frame is mounted adjacent to said vehicles to facilitate a blending of paint into areas adjacent to an area being sprayed with paint from said source.

5. A frame fixture as defined in claim 4 wherein:

said strips are formed from flat ribbons of material mounted edgewise to said vehicle to provide masking of areas adjacent to an area being sprayed with paint.

6. A frame fixture as defined in claim 4 wherein said support means includes a plurality of support members, each of said support members being connected to said frame, each of said support members extending outward from said frame to contact a portion of said vehicle and support said frame.

* * * * *